US009801454B2

(12) United States Patent
Thompson

(10) Patent No.: US 9,801,454 B2
(45) Date of Patent: Oct. 31, 2017

(54) SPORTS EQUIPMENT CARRIER WHICH CAN BE WORN

(71) Applicant: Gary McClellan Thompson, El Segundo, CA (US)

(72) Inventor: Gary McClellan Thompson, El Segundo, CA (US)

(73) Assignee: Gary McClellan Thompson, El Segundo, CA (US)

( * ) Notice: Subject to any disclaimer, the term of this patent is extended or adjusted under 35 U.S.C. 154(b) by 67 days.

(21) Appl. No.: 15/083,559

(22) Filed: Mar. 29, 2016

(65) Prior Publication Data

US 2016/0286940 A1 Oct. 6, 2016

Related U.S. Application Data

(60) Provisional application No. 62/140,382, filed on Mar. 30, 2015.

(51) Int. Cl.

| | |
|---|---|
| ***A45F 3/14*** | (2006.01) |
| ***B63B 35/79*** | (2006.01) |
| ***A45F 4/00*** | (2006.01) |

(52) U.S. Cl.

CPC ..... *A45F 3/14* (2013.01); *A45F 4/00* (2013.01); *B63B 35/7946* (2013.01); *A45F 2003/142* (2013.01); *A45F 2004/006* (2013.01)

(58) Field of Classification Search

CPC ..... A45F 3/14; A45F 3/02; A45F 2003/142; A45F 2005/1013; A45F 2005/1006; A45F 2005/006; A45F 5/00; A63C 11/025; B65D 63/16; B65D 2312/02; B63B 35/746; B63B 35/79; B63B 35/7946; Y10S 224/917; Y10T 24/27; Y10T 24/2708; Y10T 24/4084; Y10T 224/25; Y10T 224/257–224/258

USPC ..... 224/257; D3/221

See application file for complete search history.

(56) References Cited

U.S. PATENT DOCUMENTS

| | | | | |
|---|---|---|---|---|
| 3,591,063 A | | 7/1971 | Pearce | |
| 3,777,007 A | | 12/1973 | Gould et al. | |
| 3,920,166 A | * | 11/1975 | Hogensen, Jr. | A45F 5/00 2/312 |
| 3,947,927 A | * | 4/1976 | Rosenthal | A63C 11/025 128/DIG. 15 |

(Continued)

FOREIGN PATENT DOCUMENTS

| | | |
|---|---|---|
| DE | 3225842 A1 | 2/1984 |
| FR | 2490597 A1 | 3/1982 |

(Continued)

*Primary Examiner* — Adam Waggenspack

(57) ABSTRACT

A device for carrying a surfboard, similar sporting equipment or other objects. One embodiment is comprised of webbing material with fixed loop 24 having a buckle 22 that slides along the fixed loop 24 and a strap element 20 that in combination with the buckle 22 creates a secondary adjustable loop. The secondary adjustable loop is used to hold a surfboard or other object securely in place and the fixed loop 24 supports the surfboard from one of the user's shoulder allowing hands free operation. When not utilized as a carrier the device can be worn, such as a belt. The user keeps the fixed loop 24 compressed together, wraps the carrier around his/her waist, through the buckle 22 and then attaches it back onto itself.

15 Claims, 7 Drawing Sheets

(56) References Cited

U.S. PATENT DOCUMENTS

| | | | |
|---|---|---|---|
| 4,483,380 | A | 11/1984 | Beran |
| 4,724,989 | A | 2/1988 | Silberberg |
| 4,804,025 | A | 2/1989 | Bear |
| 5,094,344 | A | 3/1992 | Savage |
| 5,110,023 | A | 5/1992 | Colin |
| D390,001 | S | 2/1998 | Lovelady et al. |
| 5,823,551 | A | 10/1998 | Conroy |
| D657,553 | S | 4/2012 | Benson |
| D703,950 | S | 5/2014 | Vitale |
| 2004/0056060 | A1 | 3/2004 | Iannini et al. |
| 2005/0236450 | A1 | 10/2005 | Iannini |
| 2008/0057805 | A1 | 3/2008 | Alexander |

FOREIGN PATENT DOCUMENTS

| | | |
|---|---|---|
| WO | 85/01194 | 3/1985 |
| WO | 95/01112 | 1/1995 |

* cited by examiner

SPORTS EQUIPMENT CARRIER WHICH CAN BE WORN

CROSS-REFERENCE TO RELATED APPLICATIONS

This application claims the benefit of U.S. Provisional Patent Application No. 62/140,382, filed on 30 Mar. 2015 entitled "Surfboard Sling which can be worn while surfing" pursuant to 35 USC 119, which application is incorporated fully herein by reference.

BACKGROUND OF THE INVENTION

1. Field of the Invention

This invention relates to devices for carrying objects such as surfboards, standup paddleboards (SUP), snow board, snow skies, and the like.

2. Background

The following is a tabulation of some prior art the presently appears relevant:

U.S. PATENTS

| Patent Number | Kind Code | Issue Date | Patentee |
|---|---|---|---|
| 3,777,007 | 224-205 | August 1968 | Gaylor |
| 3,591,063 | 224-55 | July 1971 | Pearce |
| 4,483,380 | 206/315.1 | November 1984 | Beran |
| 4,804,025 | 224/604 | February 1989 | Bear |
| 5,094,344 | 206/315.1 | March 1992 | Savage |
| 4,724,989 | 224/609 | February 1988 | Silberberg |
| 5,823,551 | 280/47.131 | October 1998 | Conroy |

FOREIGN PATENT DOCUMENTS

| Foreign Doc. Nr. | Kind Code | Publ. Date | Country |
|---|---|---|---|
| 2490597 | 224/917 | March 1982 | France |
| 3225842 | 206/523 | February 1984 | Germany |
| 8501194 | 224/917 | March 1985 | PCT Int'l Appl. |
| 20050236450 | 224/577.000 | 2005 Oct. 27 | PCT Int'l Appl |
| 20080057805 | B63B 35/79 | June 2008 | PCT Int'l Appl. |

Carrying an article like a surfboard or stand up paddleboard (SUP) to and from the water has always been a problem since the inception of surfing. Surfboard designers design surfboards to facilitate their functionality while in the water. The width of a surfboard or SUP contributes to its floating capability and thus its performance. As the width of the board increases to improve performance, it becomes more difficult to carry. In some cases, people's arms are just not long enough to carrier the surfboard or SUP. As result, many individuals have made attempts to solve this problem of carrying a surfboard to the water. These include the Sling for Surfboard (U.S. Pat. No. 3,777,007), Surfboard Carrier (U.S. Pat. No. 3,591,063), Foldable protective cover and carrier for sports equipment (U.S. Pat. No. 4,483,380), Carrying harness for surfboards and the like (U.S. Pat. No. 4,804,025), Surfboard carry case (U.S. Pat. No. 5,094,344), Sailboard carrying apparatus (U.S. Pat. No. 4,724,989), Surfboard or sailboard carrier (U.S. Pat. No. 5,823,551), System transport of machine water sport as, for example the windsurfing (U.S. Pat. No. 2,490,597), Transport protection for surfing equipment (U.S. Pat. No. 3,225,842), Carrying harness for rectangular or oval body and accessories (U.S. Pat. No. 8,501,194), Board sling (20050236450) and Devices and Methods for Carrying and Storing a Surfboard (20080057805).

All the above designs have had some deficiency in their approach. Two of the above patents U.S. Pat. Nos. 3,591,063 and 5,823,551 each require the use of at least one hand, thereby limiting the user's ability to carry other important equipment such as a wetsuit, cooler, towel, etc.

U.S. Pat. No. 3,777,007, PCT 8501194 and PCT 20080057805 each consist of two straps and some initial setup adjustments prior to use for the size of the surfboard and size of the user. A new setup would be required for a different user or a different size surfboard. This increases the time to utilize the device and discourages its use.

U.S. Pat. Nos. 4,483,380, 4,724,989 and 4,804,025 each utilize bars or rods in their approach. This complicates the assembly, has multiple parts and when not in use these bars and rods require additional area when transporting and storing them.

U.S. Pat. No. 5,094,344, PCT 20050236450, German Pat. No. 3225842 and France Pat. No. 2490597 are carrier style bags or blankets. The bag/blanket approach requires enough material to cover the surfboard which increases the cost to manufacture, store and ship.

Besides the deficiencies as described above, all of these solutions miss the one key element of the problem: a user needs to carry surfboards "from" the waters edge. The ocean is a dynamic environment such that the entry and exit point of the water may not be the same. The ocean's longshore currents (side currents) could move the user hundreds of yards down the shore from where they entered. Therefore, what is needed is an apparatus that can go with the user into the water and be readily available for use upon exit.

BRIEF SUMMARY OF THE INVENTION

In accordance with one embodiment, a sports equipment carrier which can be worn comprises a fixed loop, a buckle that can slide along the fixed loop and a strap element extending past the fixed loop attachment point. The strap element, working with the buckle creates a secondary adjustable loop having a user-defined size. The user can carry a surfboard or other object by using the fixed loop over a shoulder and the secondary adjustable loop around the surfboard. When not utilized as a carrier, the device can be worn, such as a belt. To use as a belt, the user keeps the fixed loop compressed together, wraps the carrier around his/her waist, through the buckle and then attaches it back onto itself.

ADVANTAGES

Accordingly several advantages of one or more aspects are as follows: 1) the single strap carrier solution is very simple which makes it convenient and easy to use, 2) the weight of the object being carried causes the secondary adjustable loop to auto-tighten ensuring that the surfboard or other object is securely held in place allowing hands free operation, 3) the adjustability of the secondary loop allows a single embodiment to wrap many sizes surfboards or other objects and adjusts from a child size to a grown male adult, 4) the carrier can be made from a soft material that will not damage the surfboard, 5) the single strap carrier design conveniently converts to a belt that allows it to travel with the user, 6) when it is not utilized to carry a surfboard or worn as a belt it can be folded together to reduce its size for convenient storage and 7) the single strap carrier embodiment also makes it less expensive to manufacture. These and other benefits for one or more aspects will become apparent from consideration of the following description and accompanying drawings.

BRIEF DESCRIPTION OF THE SEVERAL VIEWS OF THE DRAWINGS

I have included seven drawing sheets consisting of seventeen figures.

Figure 1:
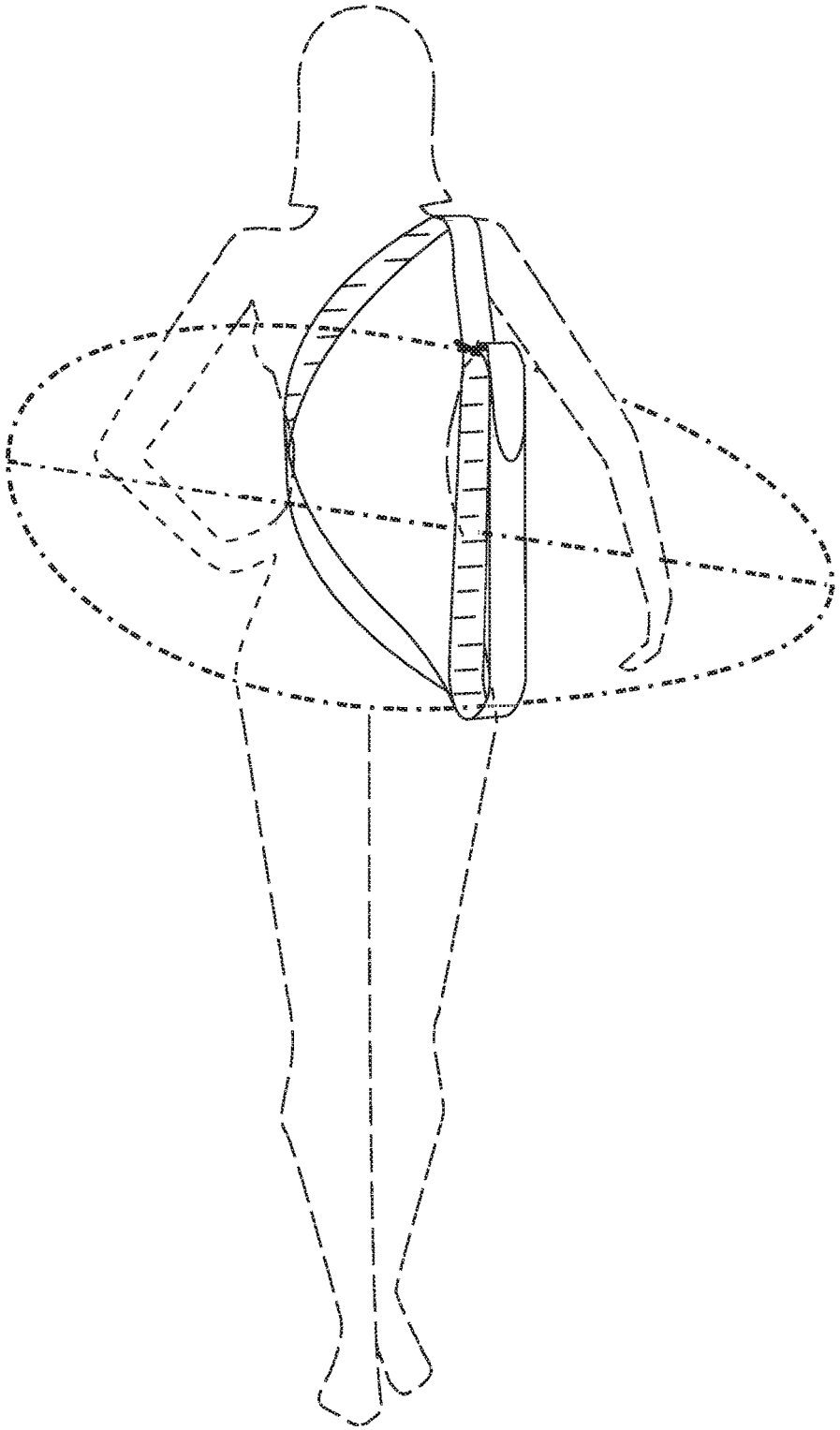
FIG. 1 shows a perspective view of a sports equipment carrier carrying a surfboard.
Figure 2:
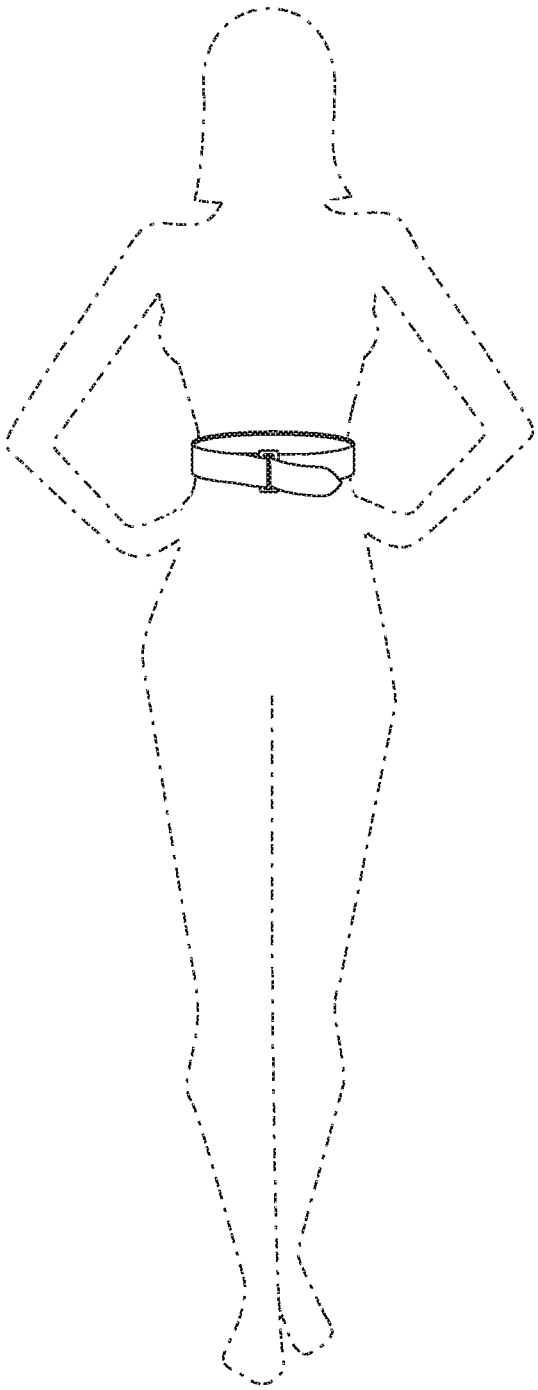
FIG. 2 shows a perspective view of a sports equipment carrier being worn as a belt.

The dashed lines of the individual and surfboard shown in FIG. 1, FIG. 2, FIG. 5, FIG. 6, FIG. 7, FIG. 8 and FIG. 10 are for illustrative purpose only and form no part of the claimed design. The sports equipment carrier is shown with broken away lines in FIGS. 3, 12-15 to indicate indeterminate length.

DRAWINGS—REFERENCE NUMERALS

- a strap element 20
- a buckle 22
- a two opening buckle 22A
- a fixed loop element 24
- a end junction point 26 (where the webbing is attached to itself to form a fixed loop)
- a tongue 28 (can be made with hook fastener)
- an attachment-surface 30 (can be made with a loop fastener)
- a hook length-reducer 32 (can be made with a hook fastener)
- a loop length-reducer 34 (can be made with a loop fastener)

DETAILED DESCRIPTION OF THE INVENTION

Figure 3:
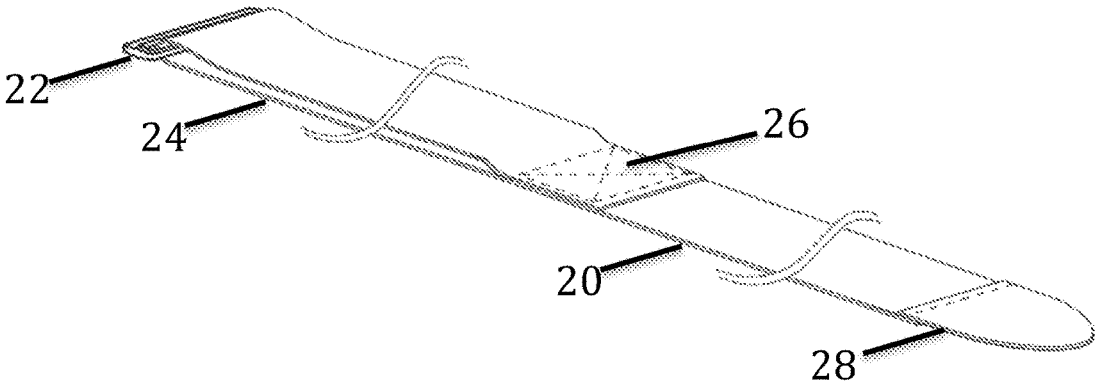
FIG. 3 shows a perspective view of a sports equipment carrier.

One embodiment of the sports equipment carrier which can be worn is shown in FIG. 3. The carrier is preferably fabricated from a polyester, polypropylene or nylon webbing but can be fabricated from any thin flexible strap, belt or equivalent material. While dimensions can vary, a reasonable size is generally about 5.08 cm (2") wide and 2.44 m (8') long. In general, pieces attaching to this webbing share its width (5.08 cm (2")) and only the length will be specified. Furthermore, it shall be assumed that throughout this description the attachment method for attached pieces will be sewing or some other suitable method. One end of the webbing is inserted through a free moving buckle 22 and folds back and attaches to itself to form a fixed loop element 24. The length of the webbing used to form the attachment junction point 26 should be sufficient length to provide a good connection for the type of material used; generally, about 5.08 cm (2") long works well. The fixed loop element 24 length can be chosen for the size of the person using the carrier and the object to be carried. Additionally, with some selection in fixed loop 24 and strap element 20 lengths the sports equipment carrier can accommodate a variety of different size surfboards and users. Generally, about ⅔ the length of the webbing material is used to form the fixed loop element 24 leaving approximately ⅓ its length leftover after the end junction point 26 to form a strap element 20. At the end of the strap element 20 can be a tongue 28 which can be made using a hook fastener. The tongue 28 length can vary but generally about 5.08 cm (2") long is a sufficient to form a good attachment when mated to a loop fastener. When hook fastener is used the hook attaches to the webbing so that the hook's surface is on the opposite side of the webbing from the junction point 26. That is, if the webbing is held horizontal, with the junction point 26 facing up then the hook surface would be facing down (see FIGS. 13 and 14). If the tongue 28 was made from a hook fastener, then attachment-surface 30 would be made from a loop fastener. The attachment-surface 30 attaches to the webbing so that the loop surface faces the same direction as the hook surface of the tongue 28. The attachment-surface 30 can extend the entire length of the sports equipment carrier with the one edge beginning at the tongue 28 and the other the edge ending at the fixed loop 24 center fold-over point (see FIG. 14). However, its length can be reduced and chosen for the waist size of its largest user. Generally, a size of at least 1.1 m (44") works well to accommodate extra large waist size (XXL). The hook and loop of connecting surfaces face the same direction so that when the tongue 28 passes through the buckle 22 and folds back towards the attachment-surface 30 they can form a hook/loop type attachment.

Figure 4:
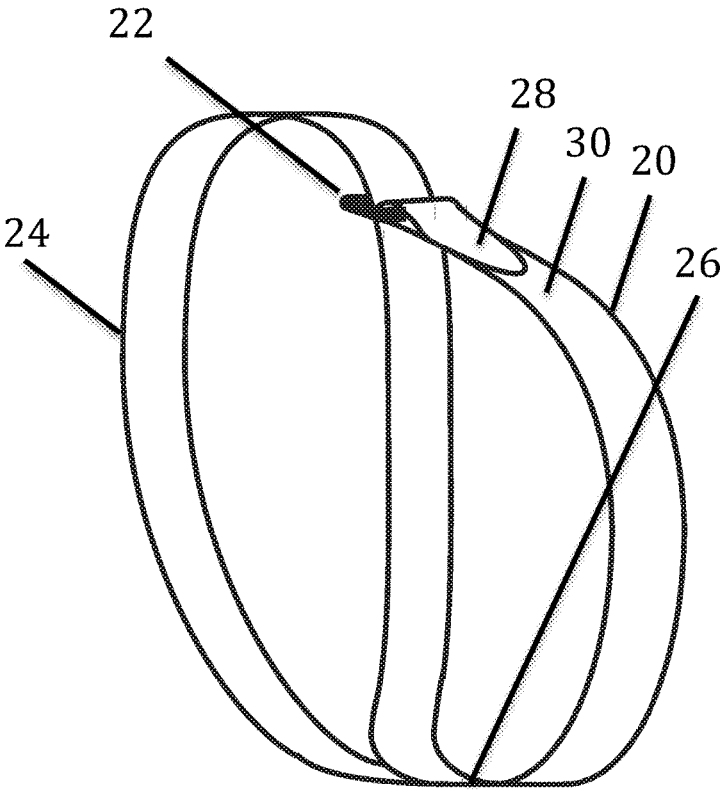
FIG. 4 shows a perspective view of a sports equipment carrier without user and without surfboard.
Figure 5:
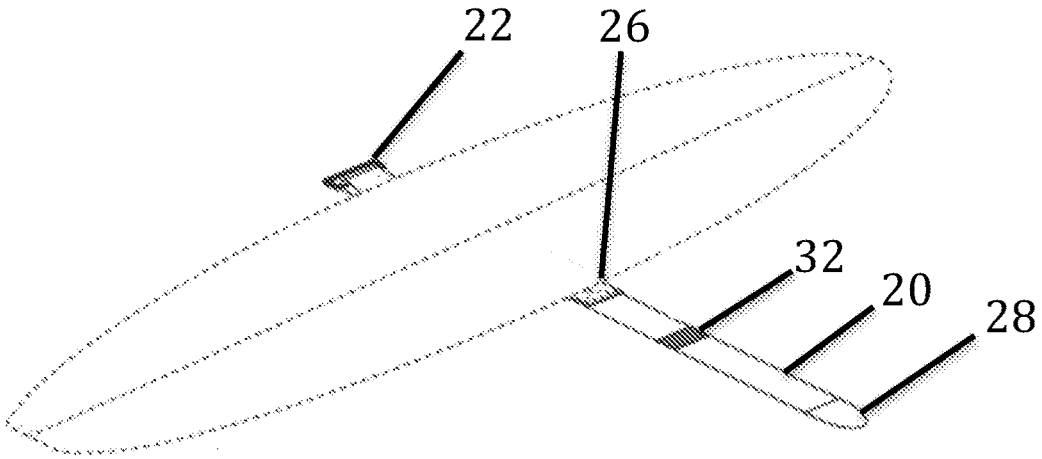
FIG. 5 shows a perspective view of a sports equipment carrier under a surfboard.
Figure 6:
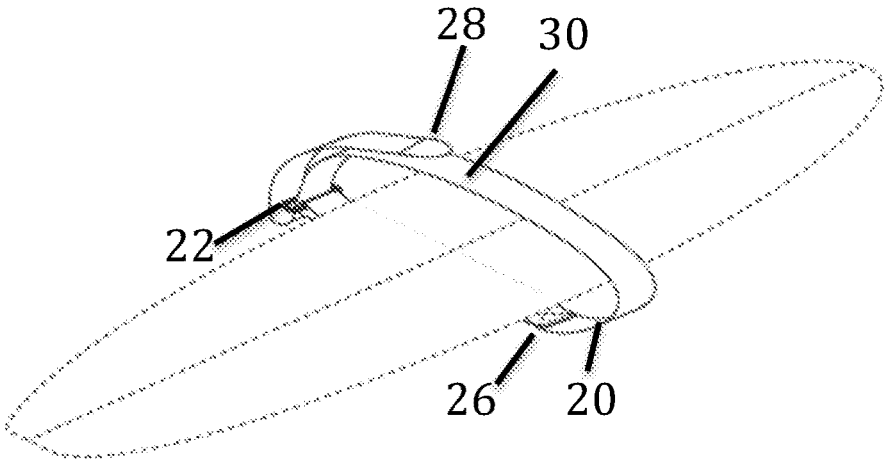
FIG. 6 shows a perspective view of a sports equipment carrier being wrapped around a surfboard.
Figure 7:
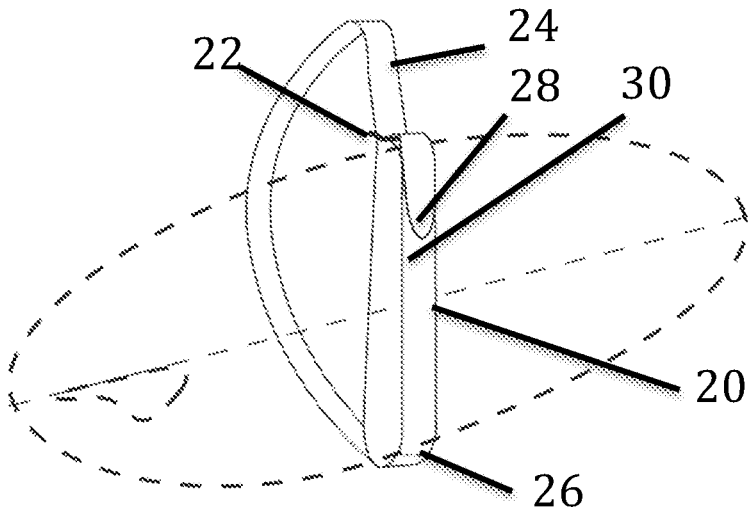
FIG. 7 shows a perspective view of a sports equipment carrier lifting a surfboard.

The sports equipment carrier can be used to carry a surfboard or other object (SUP, snow board, snow skies, sports equipment bags, mountain bicycles, firewood, lumber, etc.) by wrapping it around the lengthwise center of the surfboard, or object, at roughly the center of mass. To utilize the carrier, the user can lay the carrier with the hook surface of the tongue 28 facing the ground. Slide the buckle 22 to approximately the center fold-over point of the fixed loop 24 leaving it easily accessible when the surfboard is in place. Lay the surfboard onto the carrier so its approximate center of mass is on top of the carrier and the length of the surfboard is perpendicular to the length of the carrier (see FIG. 5). Position the surfboard so that one lengthwise edge of the surfboard is approximately over the end junction point 26 of the carrier and the other lengthwise edge of the surfboard is nearest to the buckle 22. This should leave the strap element 20 uncovered. Take the tongue 28 with the strap element 20 and wrap it over the surfboard and feed it through the buckle 22 and back onto attachment-surface 30 to form a hook/loop type attachment (see FIG. 6). This attachment produces a secondary adjustable loop. Increasing the distance from buckle 22 to the end of the tongue 28 decreases the secondary loop for a narrower surfboard or a shorter person. Conversely, decreasing the distance from buckle 22 to the end of the tongue 28 increases the secondary loop size for a wider surfboard or taller person. This adjustment is best performed when the surfboard is held in place by the secondary adjustable loop and the carrier is on the user (see FIG. 1). Thus, it is easiest to start with a larger secondary adjustable loop by attaching the tongue 28 close to the buckle 22 and then reduce it to the desired size. Next, pull the webbing of the fixed loop 24 away from the buckle 22 which causes the secondary loop to tighten around the surfboard. By lifting the fixed loop 24 up, the surfboard can be transitioned to a vertical position (see FIG. 7) where the surfboard's weight causes the secondary adjustable loop to tighten holding the surfboard in place. Thus, the sports equipment carrier is auto-tightening to hold a surfboard securely in place. The fixed loop 24 portion of the carrier can be used to hang on a shoulder or across the body of the user to carry a surfboard (see FIG. 1 for a user with a surfboard or FIG. 4 for the carrier by itself).

While an embodiment(s) of the sports equipment carrier has distinct advantages over one or more aspects of prior art in that it is quick to install (approximately 15 seconds), its auto-tightening (holding the surfboard in place), and easily adjustable for many sizes (in seconds), it also has the distinct advantage over prior art for its ability to convert into a belt and travel with the user.

This belt is accomplished by putting the carrier in a full-length position and sliding the buckle 22 to the end which is approximately the center fold-over point of the fixed loop 24. The user shall position the carrier around the waist of his/her body with the buckle 22 in one hand the tongue 28 in the other with both the hook and loop surfaces facing away from the body. Take the tongue 28 of the strap element 20 and wrap it around the waist and feed it through the buckle 22 and fold it back onto the attachment-surface 30 forming a belt held in place by the hook/loop type attachment (see FIG. 2).

Figure 14:
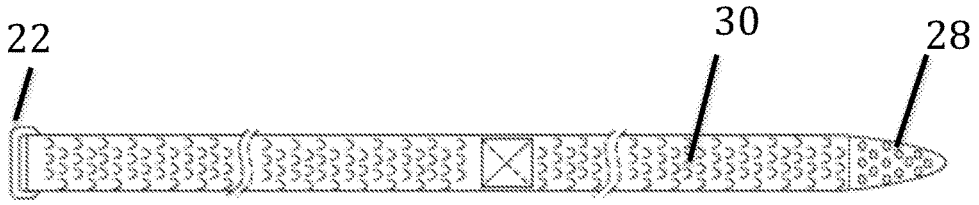
FIG. 14 shows a bottom plan view thereof.
Figure 15:
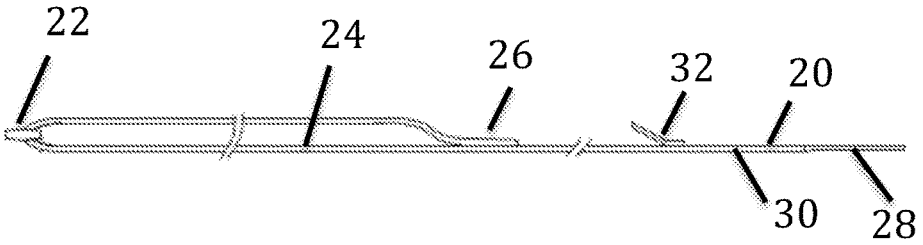
FIG. 15 shows a left elevation view thereof.
Figure 16:
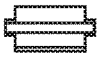
FIG. 16 shows a front elevation view thereof.
Figure 17:
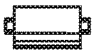
FIG. 17 shows a rear elevation view thereof.

Another embodiment(s) of sports equipment carrier can be made for users whose waist size is proportionally smaller with respect to the width of the surfboard. For this embodiment the user makes a smaller belt by first folding the carrier back on itself. To do this a hook length-reducer 32 and a loop length-reducer 34 are added to the carrier. The loop reducer 34 is not required if the attachment-surface 30 extends the entire length of the sports equipment carrier as shown in FIG. 14. The loop reducer 34 can be made from loop fastener with a length about 3.81 cm (1.5") long. The loop reducer 34 is attached with its loop surface facing out and on the same side as the attachment-surface 30. It is attached so that it is edge-to-edge with the center fold-over point of the fixed loop 24 (see FIG. 8).

The hook length-reducer 32 can be made from a hook fastener with a length of 6.35 cm (2.5"). Position the hook reducer 32 so that when the hook/loop connection is made the folded carrier length becomes the same length as the attachment-surface 30 as described above (for example 1.1 m (44")). When a folded carrier has an attachment-surface 30 length of 1.1 m (44") the carrier will accommodate a waist size from 1.1 m (44") down to half that length or 0.55 m (22"). Attach the hook reducer 32 on the same side of the webbing as the junction point 26. In this embodiment, attach hook reducer 32 with the hook surface facing in towards the webbing (the reason for this will soon become evident). In addition, attach only a portion (approximately 20%) of the hook material (approximately 1.27 cm (0.5")) to the webbing leaving the majority of the hook surface (5.08 cm (2")) available to fold up and mate with the loop.

Attaching the hook surface facing the webbing has two advantages. The first advantage is that the smooth side, and not the hook surface, is exposed to surface wax when wrapping and carrying a surfboard. This prevents wax build up on the hook surface interfering with it ability to function as loop fastener receiver. The second advantage increases the structural strength of the hook and loop connection. The ocean can be a turbulent environment with many forces acting at many angles. With the hook facing the webbing it takes more perpendicular force upon the strap element 20 to break the hook/loop connection and thus there is a lower probably the ocean will break their attachment apart resulting in the loss of the belt.

Figure 8:
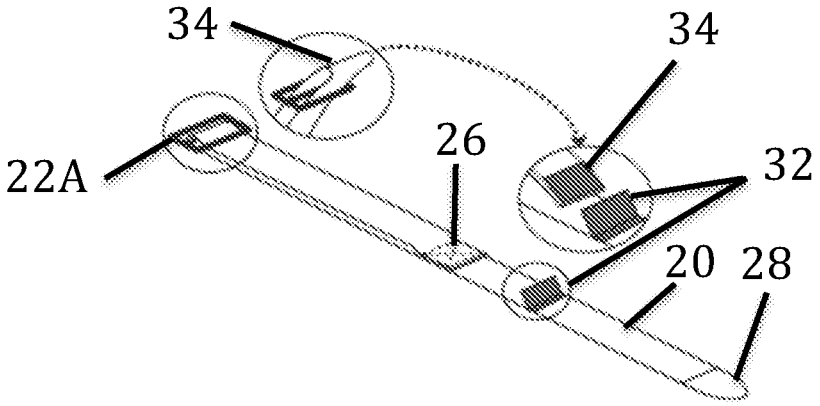
FIG. 8 shows a perspective view of a sports equipment carrier folding down to reduce the belt size.
Figure 9:
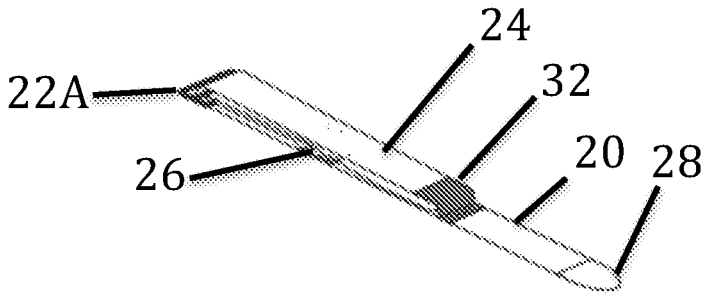
FIG. 9 shows a perspective view of a sports equipment carrier folded to become a belt laid flat.
Figure 10:
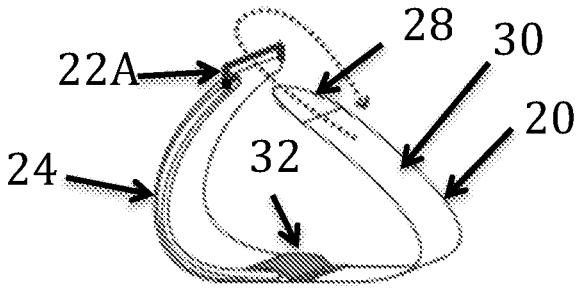
FIG. 10 shows a perspective view of a sports equipment carrier wrapping as a belt.

As described above the attachment-surface 30 or loop reducer 34 can be connected to the hook reducer 32 (see FIG. 8). This folded carrier makes for a smaller belt (see FIG. 9). When using this length shortening technique a two open buckle 22A (see FIG. 8) is preferred over a standard single opening buckle 22 (see FIG. 3). When the carrier is folded over to be worn as a belt the second inner opening of the two opening buckle 22A holds the inner fold of the webbing in place when it is in the folded position (see FIG. 9. and 10). This prevents the inner fold from being dislodged in the ocean's turbulent environment and reduce the tension on the belt.

Figure 11:
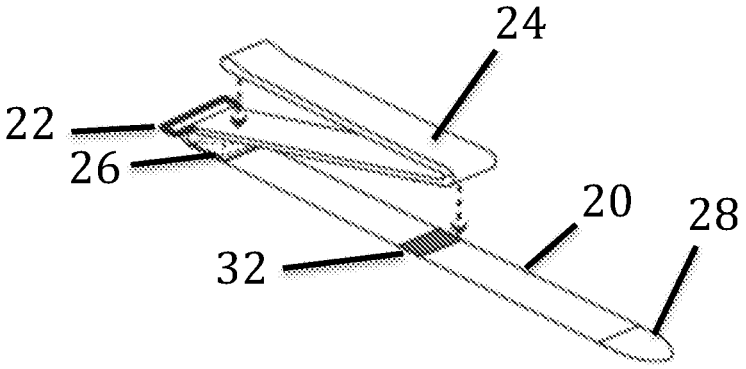
FIG. 11 shows a perspective view of a sports equipment carrier making two folds to reduce the belt size.
Figure 12:
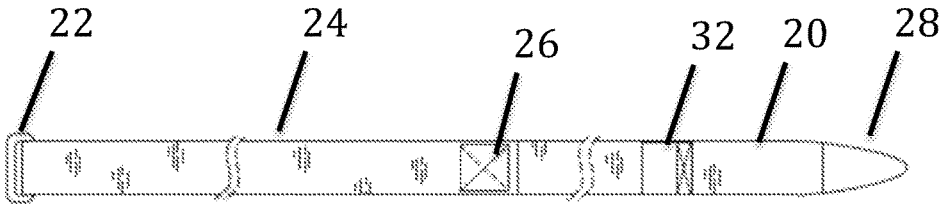
FIG. 12 shows a top plan view thereof.
Figure 13:
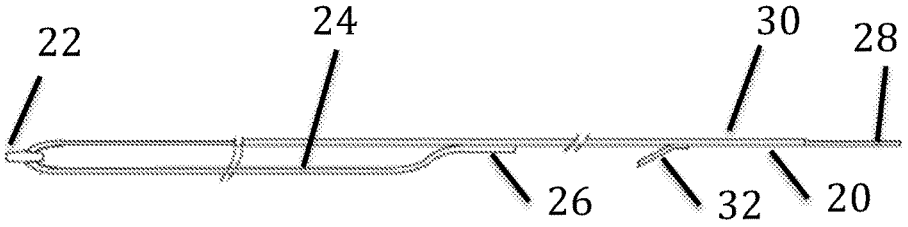
FIG. 13 shows a right elevation view thereof.

These are not the only embodiments of my invention. Alternatively:

- Different materials, size and interconnections can be used for all components
- The webbing material could be eliminated if the attachment-surface 30 is two sided
- In lieu of hook and loop some other fastening system like fasteners, snaps, buttons, etc. can be used for securing the surfboard or other object
- In lieu of a buckle or two opening buckle some other length adjusting system like a ring, etc. can be used
- In lieu of one fold, two or more folds could be made to further decrease the size of the carrier (see FIG. 11) and various connections and buckles can hold the folded material in place

I claim:

1. An equipment carrying device comprising:

a strap element comprising opposing first and second faces, said strap element having a first end, a second end and a junction point intermediate the first and second ends;

a buckle slidably disposed along the strap element between the first end and the junction point; and a plurality of fastening patches attached to the strap element, where the first face at the first end is permanently and immovably attached to the first face at the junction point to define a fixed first loop sized to receive a user's shoulder, with the buckle being positionable along the fixed first loop, and one or more of the fastening patches are provided on the second face proximal the second end, where the second end of the strap element is insertable through the buckle and attachable to a user-selected location on the strap element via the fastening patches, thereby creating an adjustable second loop suitable for securing an object to be carried, and one or more of the fastening patches are provided on the second face at a location distal from the second end, enabling the adjustable second loop to be sized for wearing the device as a belt around a waist of the user.

2. The equipment carrying device according to claim 1 further comprising a tongue provided at the second end of the strap element, where the tongue facilitates inserting the second end of the strap element through the buckle prior to forming the adjustable second loop.

3. The equipment carrying device according to claim 1 wherein the adjustable second loop has a size suitable to carry a surfboard or a stand-up paddleboard.

4. The equipment carrying device according to claim 1 further comprising additional fastening patches, on the second face of the strap element at a location halfway around the fixed first loop from the junction point, and on the first face of the strap element at a location between the junction point and the second end, where the additional fastening patches are suitable for doubling over and securing the first fixed loop, thereby shortening a distance between the buckle and the second end to achieve improved fit when wearing the device as a belt around the waist of the user.

5. The equipment carrying device according to claim 4 wherein the buckle includes two slots, where the fixed first loop is permanently fitted through a first slot, and the adjustable second loop is passable through a second slot.

6. The equipment carrying device according to claim 1 wherein the strap element is comprised of a polyester, polypropylene or nylon webbing material.

7. The equipment carrying device according to claim 6 wherein the webbing material has a width in a range of 1.27-7.62 centimeters (0.5-3.0 inches) and a length in a range of 0.92-3.08 meters (3.0-10.0 feet).

8. The equipment carrying device according to claim 1 wherein the fastening patches are mating pieces of hook-and-loop type fastener material.

9. The equipment carrying device according to claim 8 wherein one of the fastening patches is a piece of loop type material on the second face of the strap element which extends from a location proximal the second end to a location between the first end and the junction point.

10. The equipment carrying device according to claim 1 wherein the junction point is located at a position ⅔ of a distance from the first end to the second end of the strap element.

11. The equipment carrying device according to claim 1 wherein the first end is attached to the junction point by sewing to define the fixed first loop.

12. A wearable surfboard carrying sling, said sling comprising:

a strap element having opposing first and second faces, a first end, a second end and a junction point;

a buckle slidably disposed along the strap element between the first end and the junction point;

a patch of hook-type fastener material attached to second face of the strap element proximal the second end; and a length of loop-type fastener material attached to second face of the strap element which extends from a location proximal the patch of hook-type fastener material to a location between the first end and the junction point, where the first face at the first end is permanently and immovably attached to the first face at the junction point to define a fixed first loop sized to receive a user's shoulder, with the buckle being positionable along the fixed first loop, and where the second end of the strap element is insertable through the buckle and attachable to a user-selected location on the strap element via the hook-type and loop-type fastener materials on the second face, thereby creating an adjustable second loop suitable for securing and carrying a surfboard, and further enabling the adjustable second loop to be sized for wearing the sling as a belt around a waist of the user.

13. The surfboard carrying sling according to claim 12 further comprising a tongue provided at the second end of the strap element, where the tongue facilitates inserting the second end of the strap element through the buckle prior to forming the adjustable second loop.

14. The surfboard carrying sling according to claim 12 further comprising an additional patch of hook-type fastener material on the first face of the strap element at a location between the junction point and the second end, where the additional patch and the length of loop-type fastener material are suitable for doubling over and securing the first fixed loop, thereby shortening a distance between the buckle and the second end to achieve improved fit when wearing the device as a belt around the waist of the user.

15. The surfboard carrying sling according to claim 12 wherein the buckle includes two slots, where the fixed first loop is permanently fitted through a first slot, and the adjustable second loop is passable through a second slot.

* * * * *